US006160973A

United States Patent [19]

Mui

[11] Patent Number: 6,160,973

[45] **Date of Patent: *Dec. 12, 2000**

[54] DECREASED MEDIA TRANSPORT TIME FOR IMAGE FORMING DEVICES

[75] Inventor: Paul K. Mui, Boise, Id.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/740,944

[22] Filed: Nov. 5, 1996

[51] Int. Cl.[7] ..... B41J 2/385; G03G 9/08; G03G 15/20; G03G 15/00

[52] U.S. Cl. ..... 399/68; 347/156; 399/396; 399/405

[58] Field of Search ..... 347/156, 155; 399/16, 67, 332, 322, 68, 396, 405

[56] References Cited

U.S. PATENT DOCUMENTS 4,299,458 11/1981 Burton .
4,928,141 5/1990 Poehlein et al. .

*Primary Examiner*—John Barlow
*Assistant Examiner*—Raquel Yvette Gordon

[57] ABSTRACT

A method of decreasing wait time for a printed page and an image forming device implementing the method which includes an output transport mechanism configured to provide a higher linear velocity for print media than the linear velocity at which the media is transported through the rest of the image forming device. The rollers or other motion imparting apparatus of the output transport mechanism are driven at a higher linear velocity, but connected to their drive source using a slip drive mechanism. The slip drive mechanism maintains a predetermined tension on the media so that the media cannot be deformed before it has completely exited from the print engine. The overall time needed to deliver a printed image to the user is significantly shortened.

10 Claims, 1 Drawing Sheet

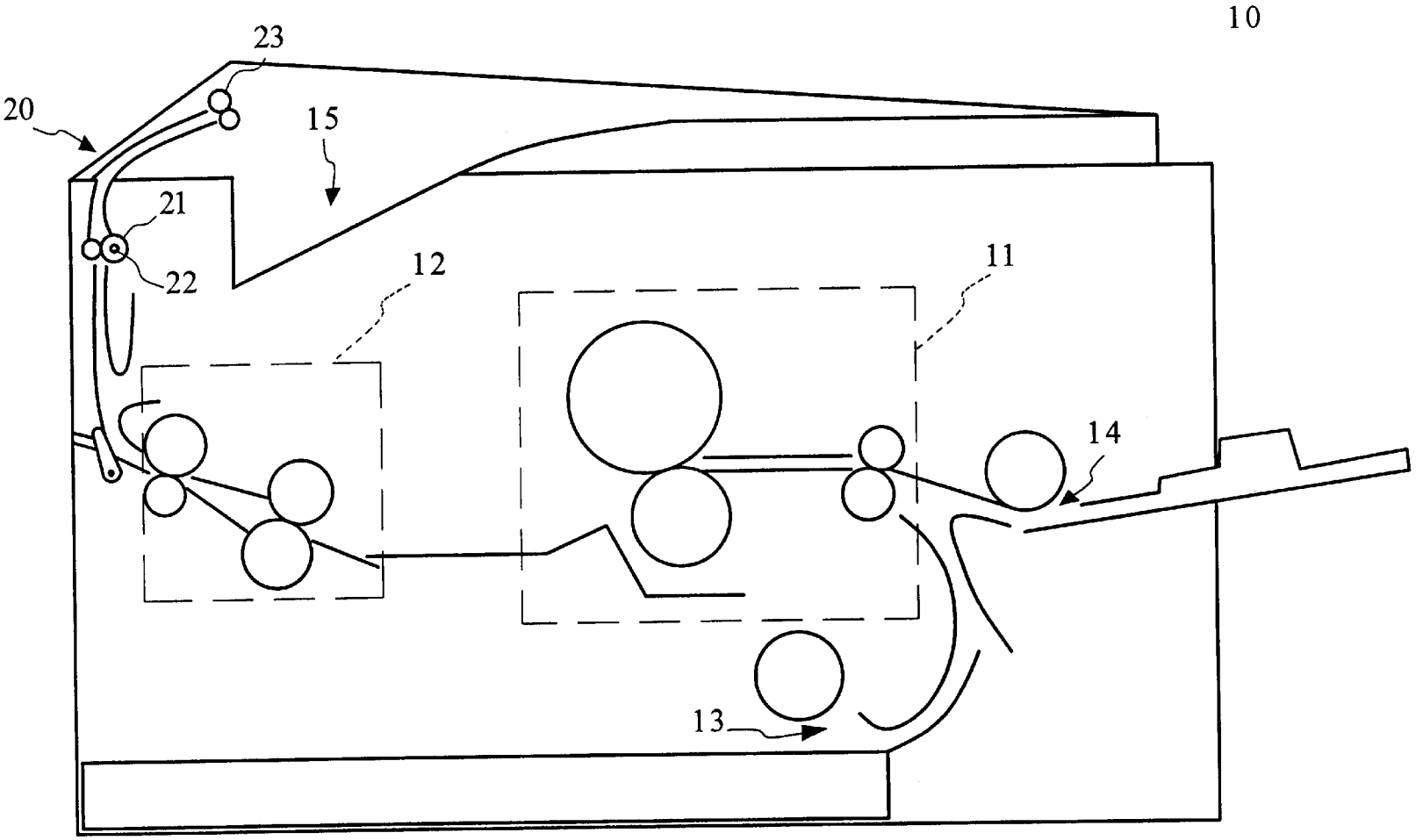
Figure

DECREASED MEDIA TRANSPORT TIME FOR IMAGE FORMING DEVICES

FIELD OF THE INVENTION

This invention generally relates to image forming devices such as laser printers and the like. More particularly, this invention relates to a method and apparatus for improved media transport time in an image forming device.

BACKGROUND OF THE INVENTION

In a typical image forming device, such as a standard laser printer, the media transport system usually includes five general areas: 1) a pick up area in which media from a supply source, such as a paper tray, is picked up a single sheet at a time; 2) a registration mechanism which aligns the print media in the image forming device and synchronizes the leading edge of the media with the print mechanism; 3) an imaging area in which the print mechanism applies the printed image to the media; 4) a fuser area in which the image is fused to the print media; and 5) an output transport mechanism through which the media is transported to an output tray after the media has exited the fuser.

The speed at which media travels through the image forming device has been limited by one or more of the processes. In a standard laser printer, the fuser mechanism limits the velocity of media since heat and pressure must be applied over a minimum time period in order to fuse the image to the media. The linear velocities of all of the rollers in the gear train are designed to be identical so that media transport speeds are synchronized in all areas. The electrophotographic printing process is completed as soon as the media exits from the fuser. However, even though the process is complete, the media is still transported from the fuser to the output area of the image forming device at the same linear velocity. The overall time needed to deliver a printed image to the user is unnecessarily lengthened because of the limited linear velocity determined by the fuser mechanism.

What is needed is a method and apparatus for decreasing the amount of time it takes to deliver a printed media sheet to the user from an image forming device.

SUMMARY OF THE INVENTION

This need, as well as others, is at least partially satisfied by an image forming device including an output transport mechanism having a higher linear velocity than the linear velocity at which the media is transported through the image fixing mechanism. The rollers or other motion imparting apparatus of the output transport mechanism are driven at a higher linear velocity, but connected to their drive source using a slip drive mechanism. The slip drive mechanism maintains a predetermined tension on the media so that the media cannot be deformed before it has completely exited from the fuser mechanism. The overall time needed to deliver a printed image to the user is significantly shortened.

BRIEF DESCRIPTION OF THE DRAWINGS

The FIGURE is a schematic side sectional view of an image forming device incorporating a faster media output transport mechanism in accordance with the invention.

DETAILED DESCRIPTION OF THE INVENTION

Referring now to the FIGURE, an image forming device 10 is shown in schematic form. Included within image forming device 10 are an image formation and registration mechanism 11 and an image fusing mechanism 12, collectively referred to as the image fixing mechanism. Image forming device 10 also includes a primary media supply 13, typically a paper tray, and a secondary media supply 14 which is here a by-pass paper tray. A media output area 15 is here provided in the top of the housing of image forming device 10 to provide a convenient place for the user to pick-up their printed media when completed. A paper output transport mechanism 20 transports the printed media from image fusing mechanism 12 to media output area 15. Paper output transport mechanism 20 includes a slip drive mechanism which drives media at the same rate as the image fixing mechanism while the media is exiting the image fixing mechanism and at a higher velocity after it exits the image fixing mechanism to deliver the printed media more quickly to the user.

Generally speaking and using a typical laser printer as an illustrative example, image formation and registration mechanism 11 includes such subsystems as a data storage device for storing data to be printed, a formatter for arranging and processing the data in a manner that the print engine requires, a print engine, usually including: modulated light source such as a laser; a photoconductor for registering the modulated light data to form a latent electrostatic image thereon; a developer sub-system including: an electrostatically charged toner supply to create a visible image on the photoconductor; and a toner transfer mechanism to transfer the visible image from the photoconductor to the print media. Fuser mechanism 12, which may or may not be part of the print engine, fuses the visible image to the print media.

In this preferred embodiment, the slip drive mechanism within media output transport mechanism 20 includes a primary drive roller 21 located proximate to the output of fuser mechanism 12. Primary drive roller 21 is connected to the printer gear train using a slip clutch 22 having a preset or selectable tension release and is driven at rotational rate which corresponds to a higher linear velocity for the driven print media than it has exiting fuser 12. The slip clutch feature allows primary drive roller 21 to slip until the print media is free of fuser 12 so primary drive roller 21 will not pull the media out of fuser 12, but at the same time keeps at least a limited amount of tension on the media to help prevent curling and deformation of the media due to the heat and/or pressure exerted by fuser 12 and accelerates the print media upon exit from fuser 12. More than one such primary drive roller may be used and in fact, all of the drive rollers within media output transport mechanism 20 may be connected to the drive train using one or more slip clutches.

Here, secondary drive rollers 23 are used which are driven at a rotational rate corresponding to the higher linear velocity for the print media to maintain the higher velocity as the media exits image forming device 10 and is delivered to output area 15. Secondary drive rollers 23 are located a minimum distance, along the media path, from the image fixing mechanism, at least equal to the longest dimension of media to be printed on to ensure that a secondary drive roller cannot grip the media prior to the trailing edge of the media exiting fuser 12.

Using a Hewlett Packard LaserJet 4, which has a continuous page output of approximately eight pages per minute, without the invention, a user has to wait approximately twenty-one seconds for the first page. However, using the invention, the wait time is decreased to approximately sixteen seconds, utilizing a linear velocity within the media output transport mechanism which is approximately three times faster than the linear velocity within the image fixing mechanism. The following table illustrates approximate reduction in wait times for three Hewlett Packard printers.

| Printer Name | Standard | With Faster Linear Velocity Output Transport | Time Improvement (Percent) |
|---|---|---|---|
| | Time From Pickup to Output (Seconds) | | |
| LaserJet4 Plus | 18.16 | 15.11 | 16.80% |
| LaserJet4 | 20.88 | 16.06 | 23.08% |
| LaserJet4 P | 31.55 | 26.40 | 16.32% |

It should be noted that the linear velocities are dependent upon the diameter of the drive rollers, tension release set points of the slip drive mechanism, the rotational velocity of the drive train and the rotational velocity of any gearing connecting the slip drive to the drive roller. Other possibilities include using multiple primary drive rollers each driven at successively faster rates, resulting in an incremental acceleration of the print media through media output transport mechanism 20.

While there is shown and described the preferred embodiment of the invention, it is to be distinctly understood that this invention is not limited thereto but may be variously embodied to practice within the scope of the following claims.

What is claimed is:

1. An image forming device comprising:

an image forming mechanism disposed in a print media transport path for developing an image onto sheets of print media;

a fuser mechanism for fusing the image to the print media and disposed in the print media transport path in spaced relationship with the image forming mechanism, the print media being conveyed along the print media transport path through the image forming mechanism and the fuser mechanism at a first velocity; and an output transport mechanism for conveying the sheets of print media from the fuser mechanism along the print media transport path to an output tray, the output transport mechanism adapted to convey the print media at the first velocity prior to the print media exiting the fuser mechanism and to convey the print media at a second, higher velocity after a trailing edge of each sheet of print media has exited the fuser mechanism.

2. The image forming device of claim 1 wherein the output transport mechanism comprises a slip drive mechanism adapted to drive the print media at the first velocity prior to the print media exiting the fuser mechanism and to drive the print media at the second velocity after the trailing edge of each sheet of print media has exited the fuser mechanism.

3. The image forming device of claim 2 wherein the slip drive mechanism comprises at least one drive roller coupled by a slip clutch to a gear train and driven at a rotational rate sufficient to convey engaged print media at the second velocity, the slip clutch including a tension limit set adapted to maintain the print media at the first velocity prior to the print media exiting the fuser mechanism and accelerating the print media to the second velocity after the trailing edge of each sheet of print media exits the fuser mechanism.

4. The image forming device of claim 2 further comprising a secondary drive roller driven at a rotational rate corresponding to the second velocity for the print media and disposed in the print media transport path in spaced relationship with the fuser mechanism, separation between the secondary drive roller and the fuser mechanism being sufficient to ensure that the secondary drive roller does not engage the print media prior to the trailing edge of each sheet of print media exiting the fuser mechanism.

5. The image forming device of claim 1 further comprising a secondary drive roller driven at a rotational rate corresponding to the second velocity for the print media and disposed in the print media transport path in spaced relationship with the fuser mechanism, separation between the secondary drive roller and the fuser mechanism being sufficient to ensure that the secondary drive roller does not engage the print media prior to the print media exiting the fuser mechanism.

6. The image forming device of claim 1 wherein the second velocity is approximately three times greater than the first velocity.

7. In an image forming device including an image forming mechanism disposed in a print media transport path, a fuser mechanism disposed in the print media transport path in spaced relationship with the image forming mechanism, and an output transport mechanism for conveying the sheets of print media from the fuser mechanism along the print media transport path to an output tray, a method for reducing the amount of time required to deliver a first printed sheet of print media to the output tray, the method comprising the steps of:

conveying sheets of print media along the print media transport path through the image forming mechanism and the fuser mechanism at a first velocity; and conveying the sheets of print media along the print media transport path from the fuser mechanism to the output tray at a second, higher velocity after a trailing edge of each sheet of print media has exited the fuser mechanism.

8. The method of claim 7 including the further step of accelerating the sheets of print media to the second, higher velocity after the trailing edge of each sheet of print media has exited the fuser mechanism.

9. The method of claim 7 including the further steps of:

driving the sheets of print media using a slip drive mechanism at the first velocity while the print media is exiting the fuser mechanism; and accelerating the sheets of print media using the slip drive mechanism to the second, higher velocity after the trailing edge of each sheet of print media has exited the fuser mechanism.

10. The method of claim 7 wherein the second velocity is approximately three times greater than the first velocity.

* * * * *